US011303070B2

(12) United States Patent
Maesoba et al.

(10) Patent No.: US 11,303,070 B2
(45) Date of Patent: Apr. 12, 2022

(54) CONNECTOR AND OUTER CONDUCTOR

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventors: Hiroyoshi Maesoba, Mie (JP); Toshifumi Ichio, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/259,598

(22) PCT Filed: Jul. 18, 2019

(86) PCT No.: PCT/JP2019/028185
§ 371 (c)(1),
(2) Date: Jan. 12, 2021

(87) PCT Pub. No.: WO2020/017572
PCT Pub. Date: Jan. 23, 2020

(65) Prior Publication Data

US 2021/0320459 A1 Oct. 14, 2021

(30) Foreign Application Priority Data

Jul. 20, 2018 (JP) ..... JP2018-136693

(51) Int. Cl.
*H01R 13/6582* (2011.01)
*H01R 13/05* (2006.01)
*H01R 13/502* (2006.01)

(52) U.S. Cl.
CPC ..... *H01R 13/6582* (2013.01); *H01R 13/05* (2013.01); *H01R 13/502* (2013.01)

(58) Field of Classification Search
CPC .. H01R 13/6582; H01R 13/05; H01R 13/502; H01R 2103/00; H01R 24/40; H01R 24/50; H01R 9/05; H01R 9/0527
(Continued)

(56) References Cited

U.S. PATENT DOCUMENTS 4,349,241 A 9/1982 Juris et al.
5,147,221 A * 9/1992 Cull ..... H01R 24/40 439/585

(Continued)

FOREIGN PATENT DOCUMENTS

CN 205543506 A 8/2016
JP 2012-195315 A 10/2012

OTHER PUBLICATIONS

International Search Report dated Sep. 17, 2019 for WO 2020/017572 A1 (2 pages).

*Primary Examiner* — Gary F Paumen
(74) *Attorney, Agent, or Firm* — Abelman, Frayne & Schwab

(57) ABSTRACT

It is aimed to improve a shielding function. A male shield connector (10) is provided with male inner conductors (16), a male dielectric (20) and a male outer conductor (22). The male outer conductor (22) includes a tubular portion (31) to which a female outer conductor (62) of a female connector (50) is connected, and the tubular portion (31) includes no boundary dividing the tubular portion (31) in a circumferential direction. Since the tubular portion (31) is so formed
(Continued)

that a coupling part such as a seam or a dividing boundary such as a slit is not present, the male shield connector (10) is excellent in shielding performance.

2 Claims, 15 Drawing Sheets

(58) Field of Classification Search
USPC ..... 439/578, 581, 582
See application file for complete search history.

(56) References Cited

U.S. PATENT DOCUMENTS

| | | | | |
|---|---|---|---|---|
| 5,376,022 | A * | 12/1994 | Carr | H01R 24/38 439/668 |
| 6,386,915 | B1 * | 5/2002 | Nelson | H01R 24/566 439/584 |
| 7,938,680 | B1 * | 5/2011 | Hsieh | H01R 24/40 439/578 |
| 10,283,903 | B2 * | 5/2019 | Yamanaka | H01R 13/506 |
| 2006/0054340 | A1 * | 3/2006 | Auray | F16L 5/00 174/650 |
| 2010/0081321 | A1 * | 4/2010 | Malloy | H01R 13/187 439/578 |
| 2018/0183177 | A1 | 6/2018 | Yamanaka | |
| 2018/0205175 | A1 * | 7/2018 | Wimmer | H01R 24/40 |

* cited by examiner

CONNECTOR AND OUTER CONDUCTOR

CROSS REFERENCE TO RELATED APPLICATIONS

This application is a national phase of PCT application No. PCT/JP2019/028185, filed on 18 Jul. 2019, which claims priority from Japanese patent application No. 2018-136693, filed on 20 Jul. 2018, all of which are incorporated herein by reference.

TECHNICAL FIELD

The present invention relates to a connector and an outer conductor.

BACKGROUND

Patent Document 1 discloses, as a shield connector to be applied to a communication cable, a connector configured such that an inner conductor (inner conductor terminal) is accommodated in a dielectric (inner housing) and the dielectric is surrounded by an outer conductor (shield shell). The outer conductor is configured into a tubular shape by uniting a shield case and a shield cover formed by bending metal plate materials.

PRIOR ART DOCUMENT

Patent Document

Patent Document 1: JP 2012-195315A

SUMMARY OF THE INVENTION

Problems to be Solved

In the above conventional shield connector, it is unavoidable that a tiny clearance is formed in a connected part of the shield case and the shield cover. Further, the shield case includes a tubular portion. Since this tubular portion is formed by bending the metal plate material and splicing the metal plate material into a rectangular tube, it is unavoidable that a tiny clearance is formed in a seam. Since such a tiny clearance may reduce a shielding function of the outer conductor and affect communication performance, a countermeasure is desired.

The present disclosure was completed on the basis of the above situation and aims to improve a shielding function.

Means to Solve the Problem

A first aspect of the disclosure is directed to a connector with an inner conductor, a dielectric and an outer conductor surrounding the inner conductor and the dielectric, wherein the outer conductor includes a tubular portion to which a mating outer conductor of a mating connector is connected, and the tubular portion includes no boundary dividing the tubular portion in a circumferential direction.

A second aspect of the disclosure is directed to an outer conductor constituting a connector by surrounding an inner conductor and a dielectric, the outer conductor including a tubular portion to which a mating outer conductor of a mating connector is connected, the tubular portion including no boundary dividing the tubular portion in a circumferential direction.

Effect of the Invention

According to the first and second aspects of the disclosure, a shielding function can be improved.

DETAILED DESCRIPTION TO EXECUTE THE INVENTION

Description of Embodiments of Present Disclosure

First, embodiments of the present disclosure are listed and described.

(1) The connector of the first aspect of the disclosure includes an inner conductor, a dielectric and an outer conductor surrounding the inner conductor and the dielectric, wherein the outer conductor includes a tubular portion to which a mating outer conductor of a mating connector is connected, and the tubular portion includes no boundary dividing the tubular portion in a circumferential direction.

According to the configuration of the first aspect of the disclosure, the tubular portion is so formed that a coupling part such as a seam or a dividing boundary such as a slit dividing the tubular portion in the circumferential direction is not present. Thus, the connector of the first aspect of the disclosure can improve a shielding function.

(2) Preferably, a resilient contact member to be electrically conductive with the mating outer conductor by resiliently contacting the mating outer conductor is mounted on the tubular portion. If a contact part with a mating outer conductor is integrally formed to the tubular portion, the tubular portion needs to be formed with a cut, a boundary or the like. However, since the resilient contact member separate from the tubular portion is used according to this disclosure, the tubular portion needs not be formed with a cut or a boundary.

(3) Preferably, a groove portion is formed in a peripheral surface of the tubular portion, and at least a part of the resilient contact member is accommodated in the groove portion. According to this configuration, a clearance between a peripheral surface of the tubular portion and a peripheral surface of the mating outer conductor can be made smaller.

The outer conductor of the second aspect of the disclosure constitutes a connector by surrounding an inner conductor and a dielectric and includes a tubular portion to which a mating outer conductor of a mating connector is connected, the tubular portion including no boundary dividing the tubular portion in a circumferential direction.

According to the configuration of the second aspect of the disclosure, the tubular portion is so formed that a coupling part such as a seam or a dividing boundary such as a slit dividing the tubular portion in the circumferential direction is not present. Thus, the outer conductor of the second aspect of the disclosure can improve a shielding function.

Details of Embodiments of Present Disclosure

First Embodiment

Hereinafter, a first specific embodiment of the present disclosure is described with reference to FIGS. 1 to 12. Note that the present invention is not limited to these illustrations and is intended to be represented by claims and include all changes in the scope of claims and in the meaning and scope of equivalents.

Figure 1:
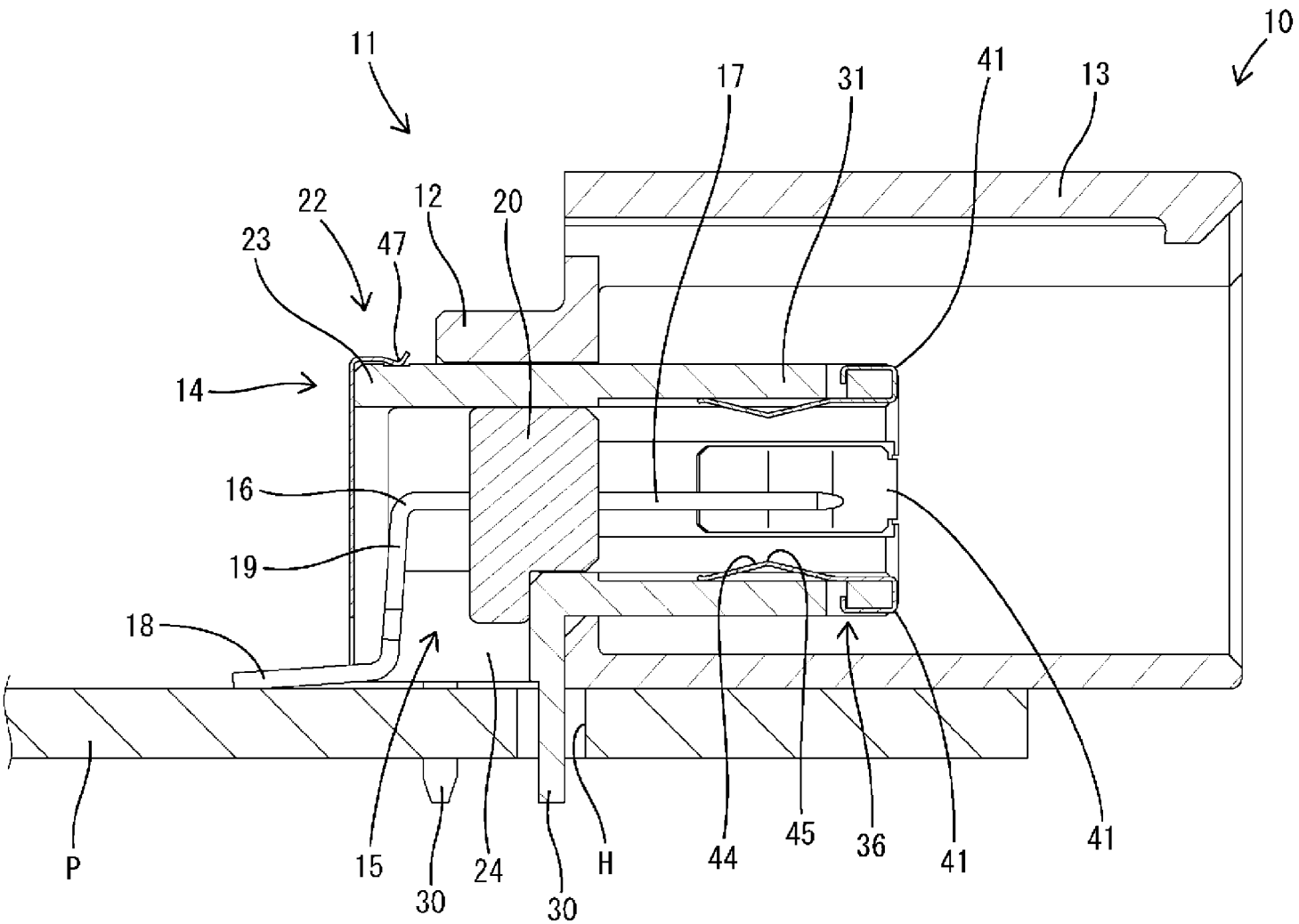
FIG. 1 is a section of a male shield connector of a first embodiment.
Figure 4:
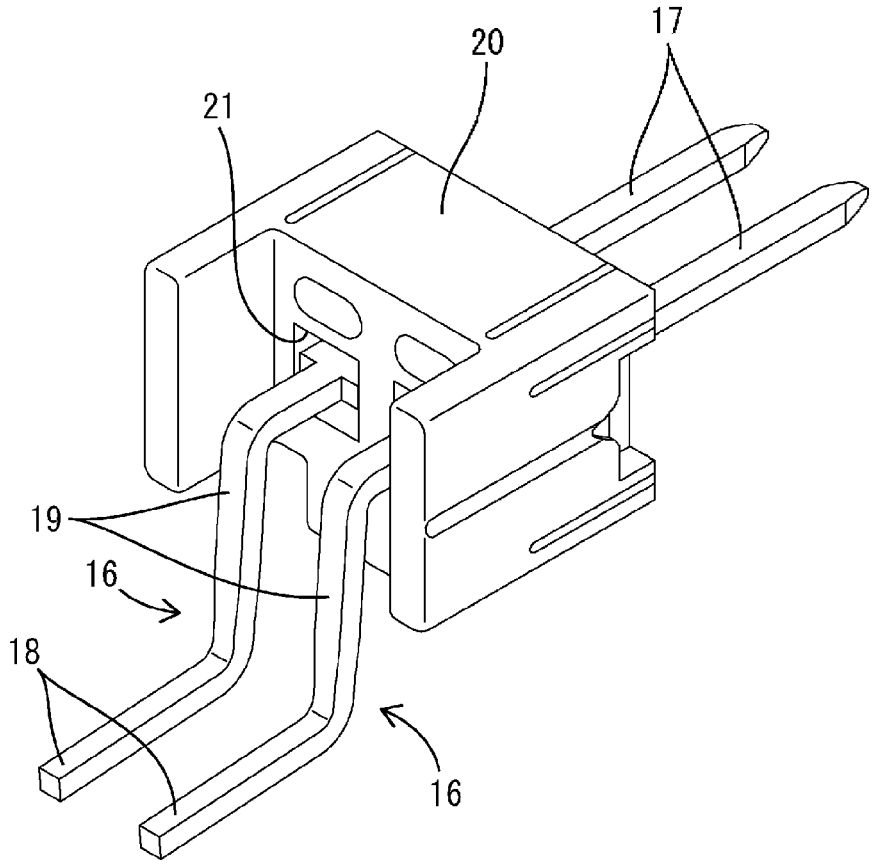
FIG. 4 is a perspective view of a male terminal unit.
Figure 5:
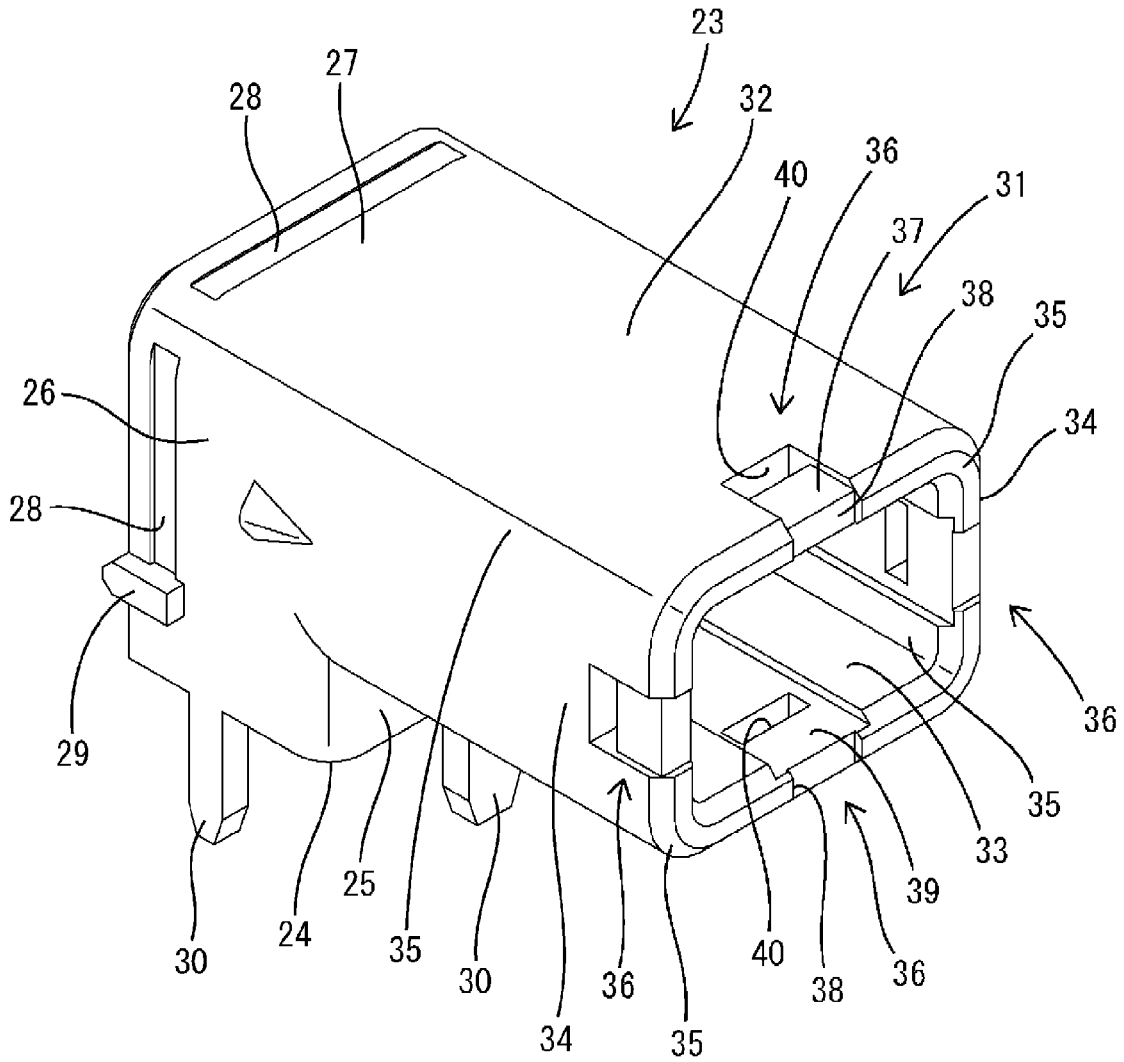
FIG. 5 is a perspective view of an outer conductor body constituting a male outer conductor.
Figure 6:
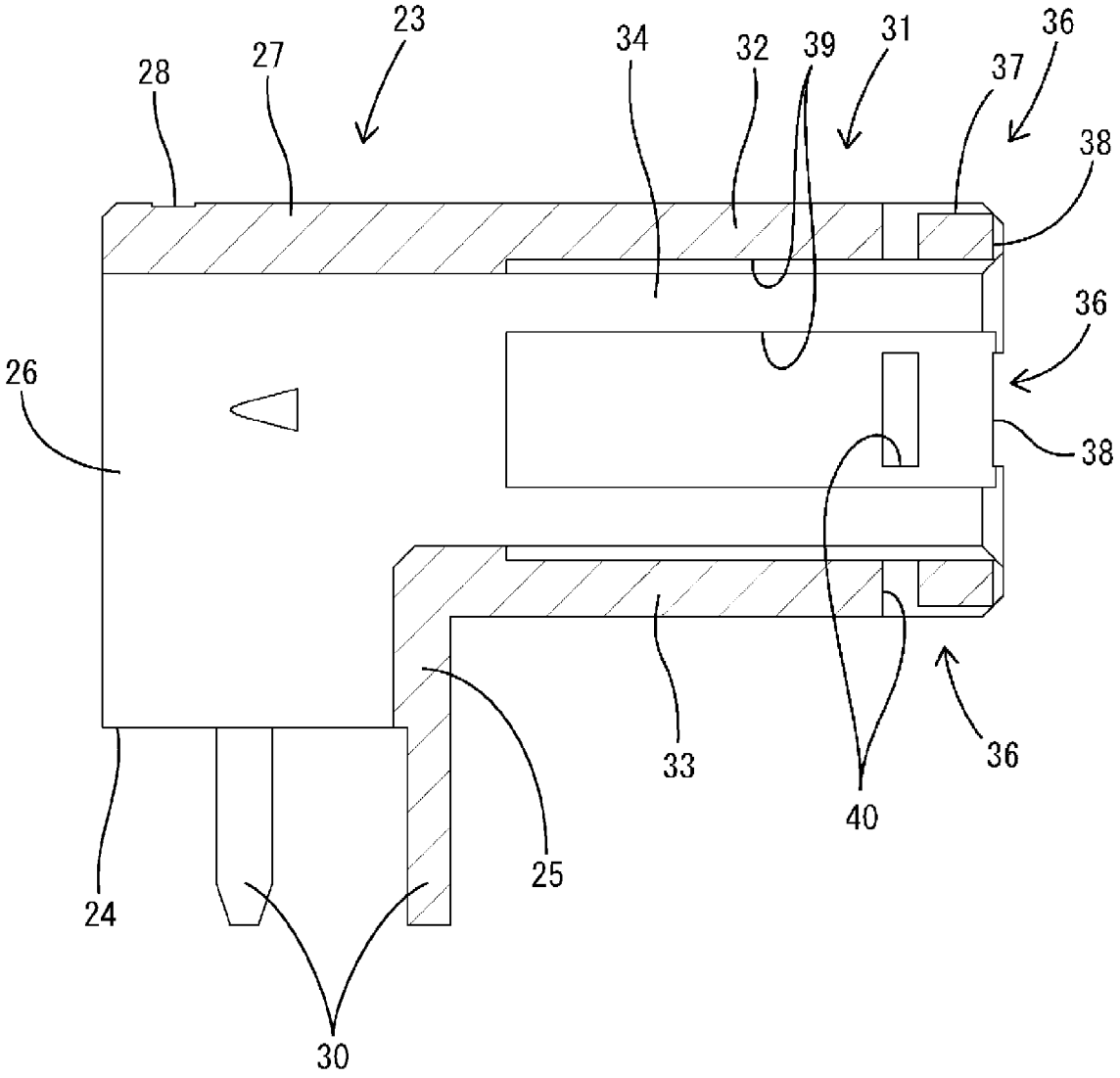
FIG. 6 is a section of the outer conductor body.

In the following description, a right side in FIGS. 1, 3 and 6 and an oblique right-lower side in FIGS. 2 and 5 to 7 is defined as a front side concerning a front-rear direction. Upper and lower sides shown in FIGS. 1 to 12 are directly defined as upper and lower sides concerning a vertical direction. Left and right sides shown in FIG. 8 are directly defined as left and right sides concerning a lateral direction.

A male shield connector 10 (connector as claimed) of the first embodiment includes, as shown in FIG. 1, a male housing 11 and a male shield terminal 14 accommodated in the male housing 11. The male housing 11 is a single member made of synthetic resin and including a tubular terminal holding portion 12 and a receptacle 13 extending forward from the terminal holding portion 12.

Figure 3:
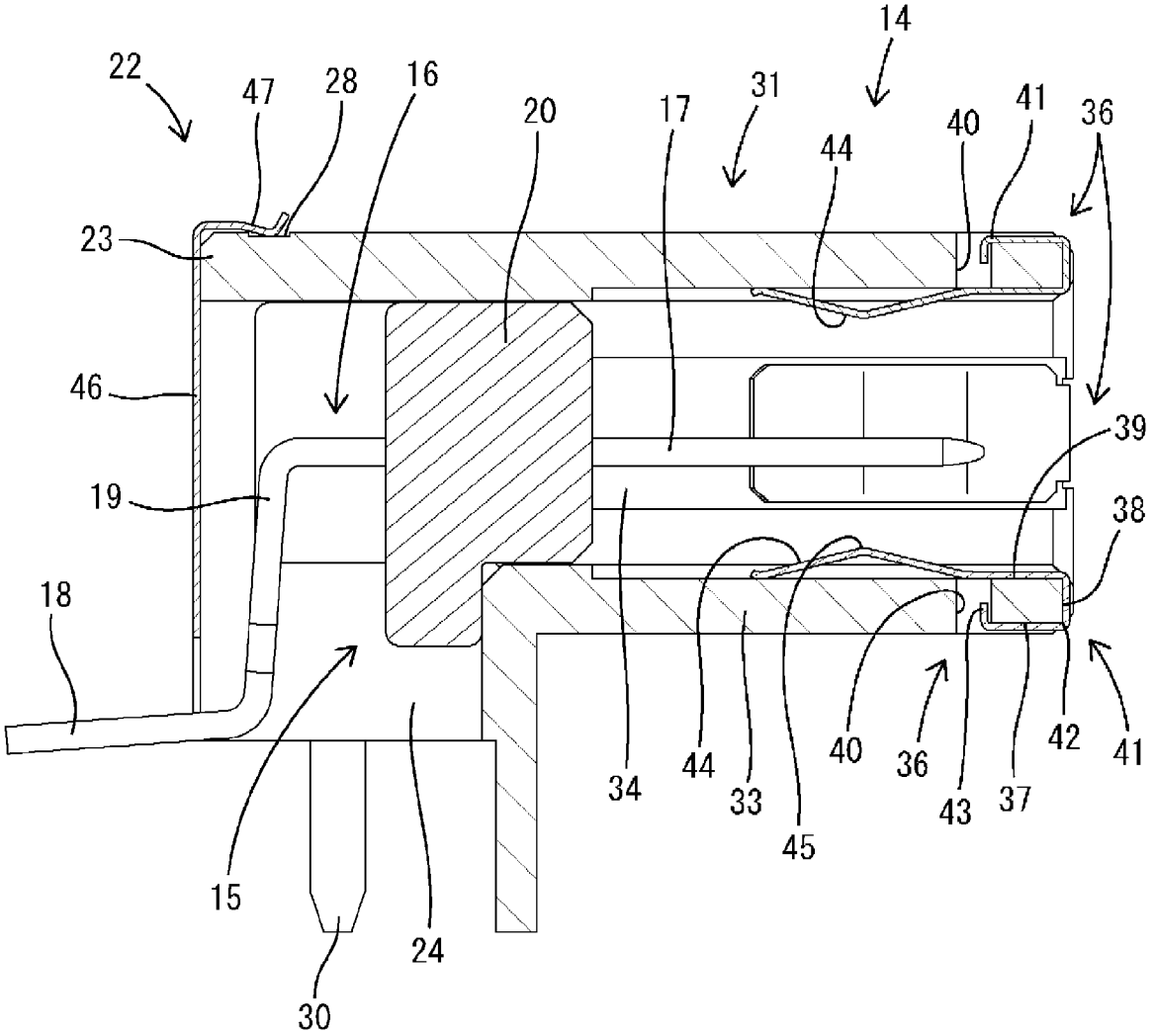
FIG. 3 is a section of the male shield terminal.

As shown in FIGS. 1 and 3, the male shield terminal 14 is configured by assembling one male terminal unit 15 and one male outer conductor 22 (outer conductor as claimed). As shown in FIG. 4, the male terminal unit 15 is configured by assembling a pair of left and right male inner conductors 16 (inner conductor as claimed) and one male dielectric 20 (dielectric as claimed).

The male inner conductor 16 is formed by bending a thin and long metal wire material into a step shape (crank shape). The male inner conductor 16 is a member of a known form that a rear end of a tab 17 extending in the front-rear direction and a front end part of a board connecting portion 18 extending in the front-rear direction are coupled by a vertical leg portion 19.

The male dielectric 20 is made of a synthetic resin material and molded into a block shape as a whole. The male dielectric 20 is formed with a pair of left and right press-fit holes 21 penetrating in the front-rear direction. The pair of male inner conductors 16 are assembled with the male dielectric 20 by press-fitting the tabs 17 into the press-fit holes 21 from behind the male dielectric 20.

The male outer conductor 22 is configured by assembling an outer conductor body 23 made of metal, resilient contact members 41 made of metal and a cover 46 made of metal. The outer conductor body 23 is a single member manufactured by casting (die casting) or cutting. The outer conductor body 23 includes a base portion 24 and a tubular portion 31.

As shown in FIGS. 5, 6 and 8, the base portion 24 includes a front surface portion 25 in the form of a wall substantially rectangular in a front view, a pair of left and right side surface portions 26 substantially rectangular in a side view and an upper surface portion 27 substantially rectangular in a plan view. A vertical dimension of the front surface portion 25 is smaller than those of the side surface portions 26, and the front surface portion 25 couples the front end edges of lower end parts of the both left and right side surface portions 26. A front-rear length of the upper surface portion 27 is equal to those of the side surface portions 26, and the upper surface portion 27 couples the upper end edges of the both side surface portions 26. An internal space of the base portion 24 is open rearward and downward of the outer conductor body 23.

A hook groove 28 extending in the lateral direction to assemble the cover 46 with the outer conductor body 23 is formed in the outer surface (upper surface) of a rear end part of the upper surface portion 27. Hook grooves 28 extending in the vertical direction to assemble the cover 46 with the outer conductor body 23 are formed also in the outer surfaces (outer side surfaces) of rear end parts of the side surface portion 26. Positioning projections 29 are formed adjacent to lower end parts of the vertical hook grooves 28 on the rear end edges of the side surface portions 26. Positioning pins 30 for positioning or fixing the male outer conductor 22 (outer conductor body 23) to a circuit board P project from the lower end surfaces of the front surface portion 25 and the both left and right side surface portions 26.

As shown in FIGS. 5, 6 and 8, the tubular portion 31 is in the form of a rectangular tube substantially rectangular in a front view and projects forward from the base portion 24. In particular, the tubular portion 31 includes a horizontal upper wall portion 32, a horizontal lower wall portion 33 and a pair of left and right side wall portions 34. Both left and right side edge parts of the upper wall portion 32 and upper end edge parts of the side wall portions 34 are linked via curved wall portions 35 having a substantially quarter-circular shape. Both left and right side edge parts of the lower wall portion 33 and lower end edge parts of the side wall portions 34 are also linked via curved wall portions 35 having a substantially quarter-circular shape.

A rear end part of the upper wall portion 32 is continuous and flush with a front end part of the upper surface portion 27 of the base portion 24. Rear end parts of the side wall portions 34 are continuous and flush with front end parts of the side surface portions 26. The rear end edge of the lower wall portion 33 is connected substantially at a right angle to the upper end edge of the front surface portion 25. An internal space of the tubular portion 31 communicates with a space in an upper end side region of the internal space of the base portion 24, and is open rearward of the outer conductor body 23 via the internal space of the base portion 24.

Out of the wall portions 32 to 35 constituting the tubular portion 31, each of the upper wall portion 32, the lower wall portion 33 and the both left and right side wall portions 34 is formed with a groove portion 36 and a mounting hole 40. The groove portion 36 and the mounting hole 40 of the upper wall portion 32 are disposed in a laterally central part of the tubular portion 31 (upper wall portion 32). The groove portion 36 and the mounting hole 40 of the lower wall portion 33 are also disposed in the laterally central part of the tubular portion 31 (lower wall portion 33). The groove portion 36 and the mounting hole 40 of the side wall portion 34 are disposed in a vertically central part of the tubular portion 31 (side wall portion 34).

The groove portion 36 of the upper wall portion 32 is composed of an outer peripheral groove 37 formed by recessing the outer surface of the upper wall portion 32 (outer peripheral surface of the tubular portion 31), a front surface groove 38 formed by recessing the front end surface of the upper wall portion 32 (front end surface of the tubular portion 31) and an inner peripheral groove 39 formed by recessing the inner surface of the upper wall portion 32 (inner peripheral surface of the tubular portion 31). The front end of the outer peripheral groove 37 and that of the inner peripheral groove 39 are both adjacent to or in communication with the front surface groove 38. A width of the outer peripheral groove 37 is equal to that of the front surface groove 38. A width of the inner peripheral groove 39 is set slightly larger than those of the outer peripheral groove 37 and the front surface groove 38. A front-rear length of the inner peripheral groove 39 is set longer than that of the outer peripheral groove 37.

The mounting hole 40 is disposed in a rear end part of the outer peripheral groove 37 and penetrates from the outer peripheral groove 37 to the inner peripheral groove 39. The mounting hole 40 has a rectangular shape in a plan view, and a width thereof is equal to that of the outer peripheral groove 37. The groove portion 36 and the mounting hole 40 of the lower wall portion 33 are arranged at positions reached by vertically symmetrically inverting the groove portion 36 and the mounting hole 40 of the upper wall portion 32. The groove portion 36 and the mounting hole 40 of the side wall portion 34 are arranged at positions reached by turning the groove portion 36 and the mounting hole 40 of the upper wall portion 32 by 90° and extend vertically. Thus, the groove portions 36 and the mounting holes 40 are not described for the lower wall portion 33 and the side wall portions 34.

The outer conductor body 23 (base portion 24 and tubular portion 31) is manufactured by casting, cutting or press-working. The outer conductor body 23 (base portion 24 and tubular portion 31) is formed such that there is no boundary dividing the outer conductor body 23 (base portion 24 and tubular portion 31) in a circumferential direction, in other words, formed into an endless shape. The "boundary" means a boundary continuous over an entire length in an axial direction of the outer conductor body 23 (base portion 24 and tubular portion 31). Thus, the groove portions 36 and the mounting holes 40 formed in the outer conductor body 23 are not boundaries dividing the outer conductor body 23 (base portion 24 and tubular portion 31) in the circumferential direction.

The male terminal unit 15 is accommodated into the outer conductor body 23 from behind the outer conductor body 23, and held in an assembled state. With the male terminal unit 15 accommodated in the outer conductor body 23, a front end part of the male dielectric 20 and parts of the tabs 17 of the male inner conductors 16 projecting forward of the male dielectric 20 are surrounded by the tubular portion 31. Further, a rear end part of the male dielectric 20 and the leg portions 19 of the male inner conductors 16 are surrounded by the base portion 24.

Figure 7:
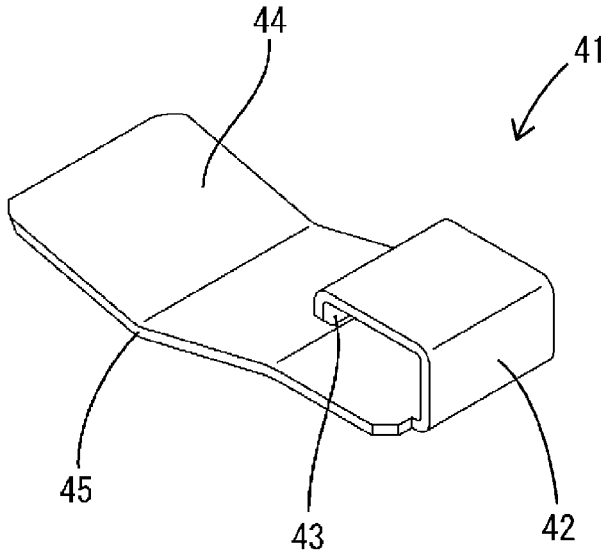
FIG. 7 is a perspective view of a resilient contact member.
Figure 8:
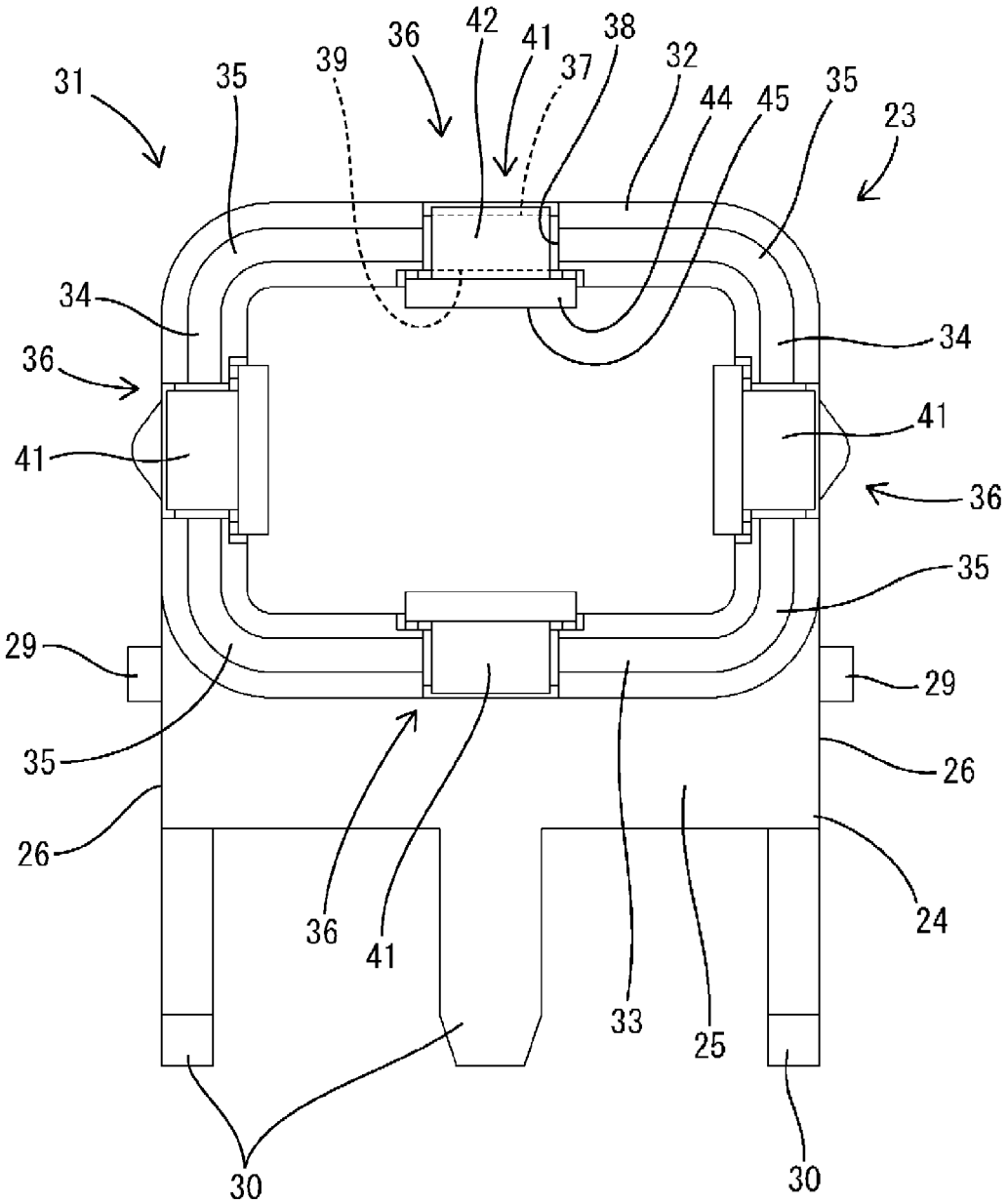
FIG. 8 is a front view showing a state where the resilient contact members are mounted on the outer conductor body.

As shown in FIG. 7, the resilient contact member 41 is formed by bending a metal plate material thinner than the wall portions 32 to 35 constituting the tubular portion 31. The tubular portion 31 (outer conductor body 23) is formed to be thick and hardly resiliently deformed, whereas the resilient contact member 41 is resiliently deformable by having springiness. The resilient contact member 41 is a single component including a fitting portion 42 bent into a substantially U shape, a retaining projection 43 projecting substantially at a right angle from one end part of the fitting portion 42 and a resilient contact piece 44 cantilevered from the other end part of the fitting portion 42. The resilient contact piece 44 is bent at an obtuse angle to form a chevron shape and a top part having an obtuse angle serves as a contact point portion 45.

Figure 2:
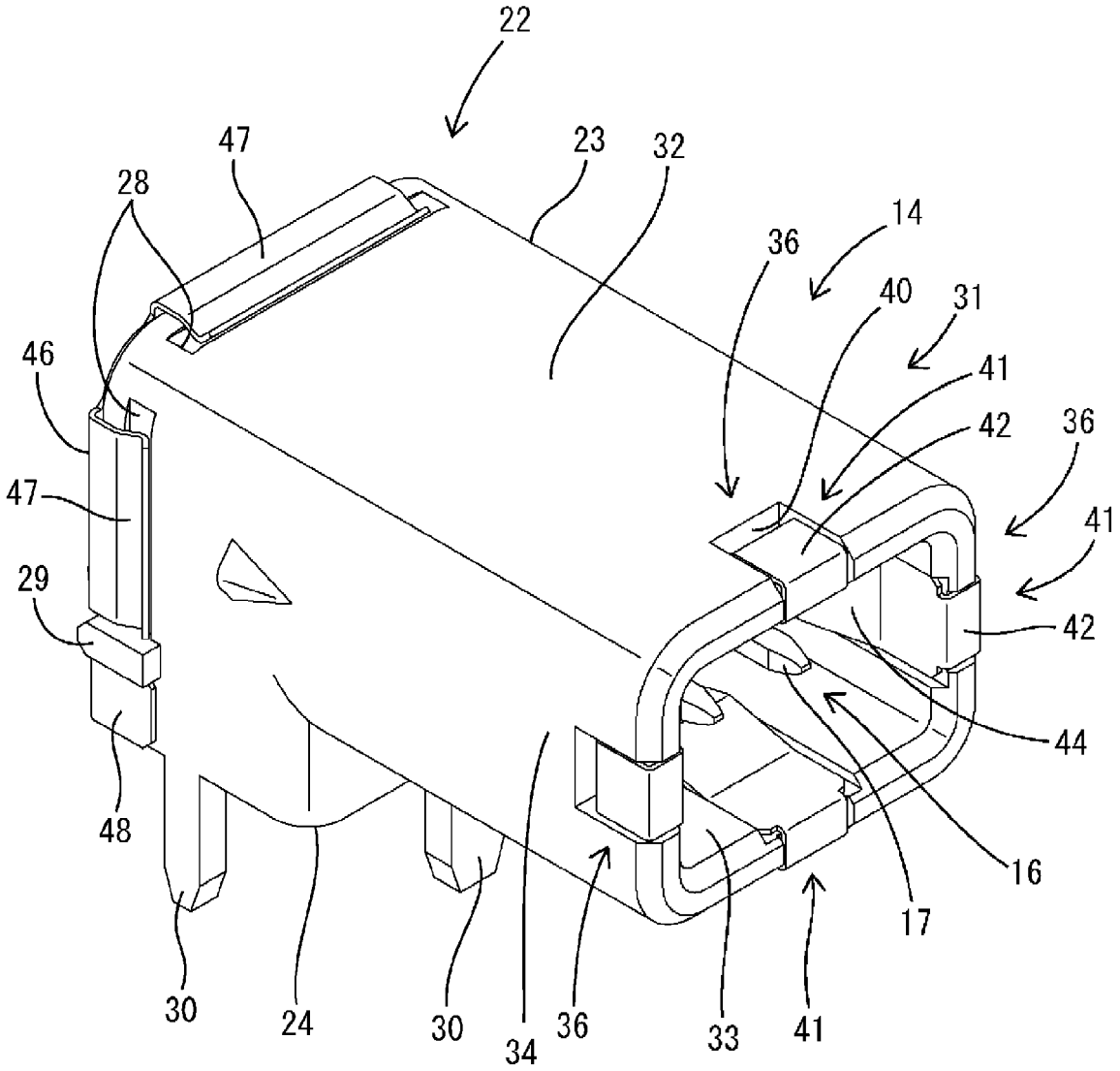
FIG. 2 is a perspective view of a male shield terminal.

As shown in FIGS. 2 and 8, four resilient contact members 41 are individually mounted in the four groove portions 36. The resilient contact member 41 is assembled with the tubular portion 31 with the fitting portion 42 accommodated and fit in front end parts of the outer peripheral groove 37, the front surface groove 38 and the inner peripheral groove 39 and the retaining projection 43 fit in the mounting hole 40. In an assembled state, both front and rear end parts of the resilient contact piece 44 are accommodated in the inner peripheral groove 39, and the contact point portion 45 projects further inward than the inner peripheral surface of the tubular portion 31.

Figure 9:
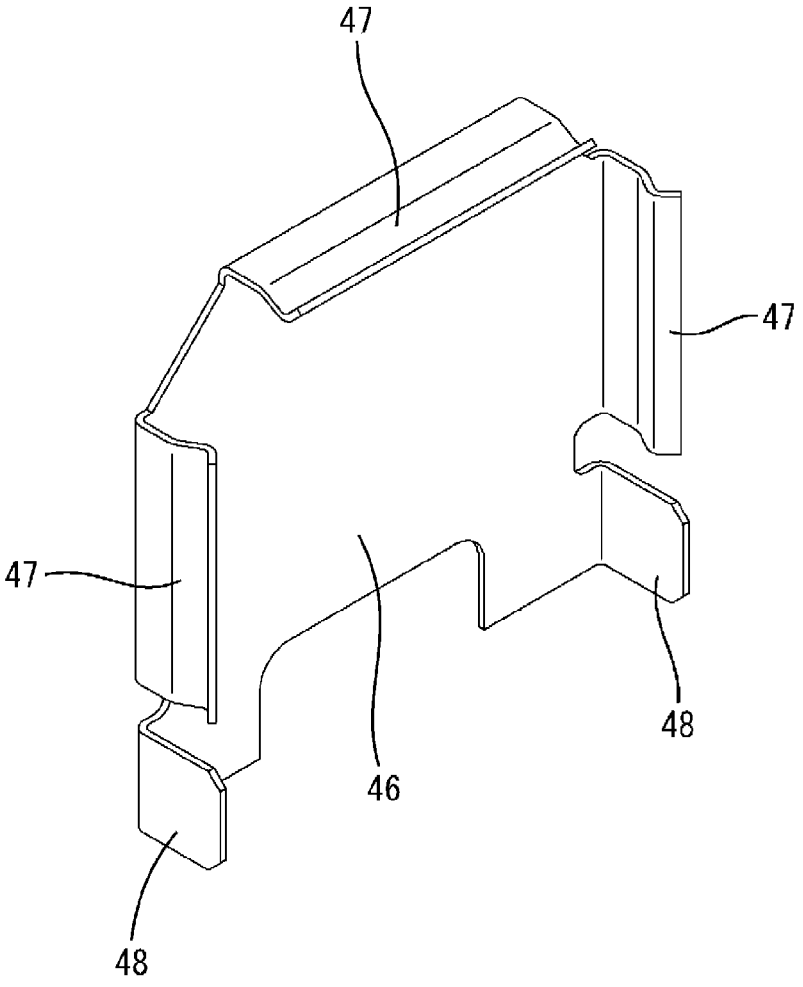
FIG. 9 is a perspective view of a cover.

As shown in FIG. 9, the cover 46 is in the form of a substantially rectangular plate as a whole. A hooking portion 47 bent to extend forward is formed on the upper end edge of the cover 46. Hooking portions 47 bent to extend forward are also formed in regions of both left and right side edges of the cover 46 except lower end parts. Restricting projections 48 spaced apart from the lower end parts of the hooking portions 47 are formed on the lower end parts of the both left and right side edges of the cover 46.

The cover 46 is assembled with the outer conductor body 23 from behind. An opening in the rear surface of the outer conductor body 23 is closed by the cover 46. The assembled cover 46 is held in an assembled state by fitting the hooking portions 47 into the hook grooves 28 of the outer conductor body 23 and fitting recesses between the lower ends of the hooking portions 47 on the side edges and the restricting projections 48 to the positioning projections 29.

By assembling the cover 46 with the outer conductor body 23, the male outer conductor 22 is configured and the male shield terminal 14 is configured. The male terminal unit 15 accommodated in the outer conductor body 23 is covered from behind by the cover 46. The board connecting portions 18 of the male inner conductors 16 project rearward of the male outer conductor 22 from the lower end edge of the cover 46. The male shield terminal 14 is mounted into the male housing 11 from behind. In a mounted state, the base portion 24 of the male outer conductor 22 is held accommodated in the terminal holding portion 12 and the tubular portion 31 is surrounded by the receptacle 13.

The male shield connector 10 is fixed to the circuit board P. Specifically, as shown in FIG. 1, the receptacle 13 of the male housing 11 is placed and fixed on the upper surface of the circuit board P, and the positioning pin 30 of the male outer conductor 22 is inserted into a positioning hole H of the circuit board P and fixed by soldering. Further, the board connecting portions 18 of the male inner conductors 16 are placed and conductively fixed to a printed circuit (not shown) of the circuit board P. That is, the male inner conductors 16 are surface-mounted on the circuit board P.

Figure 12:
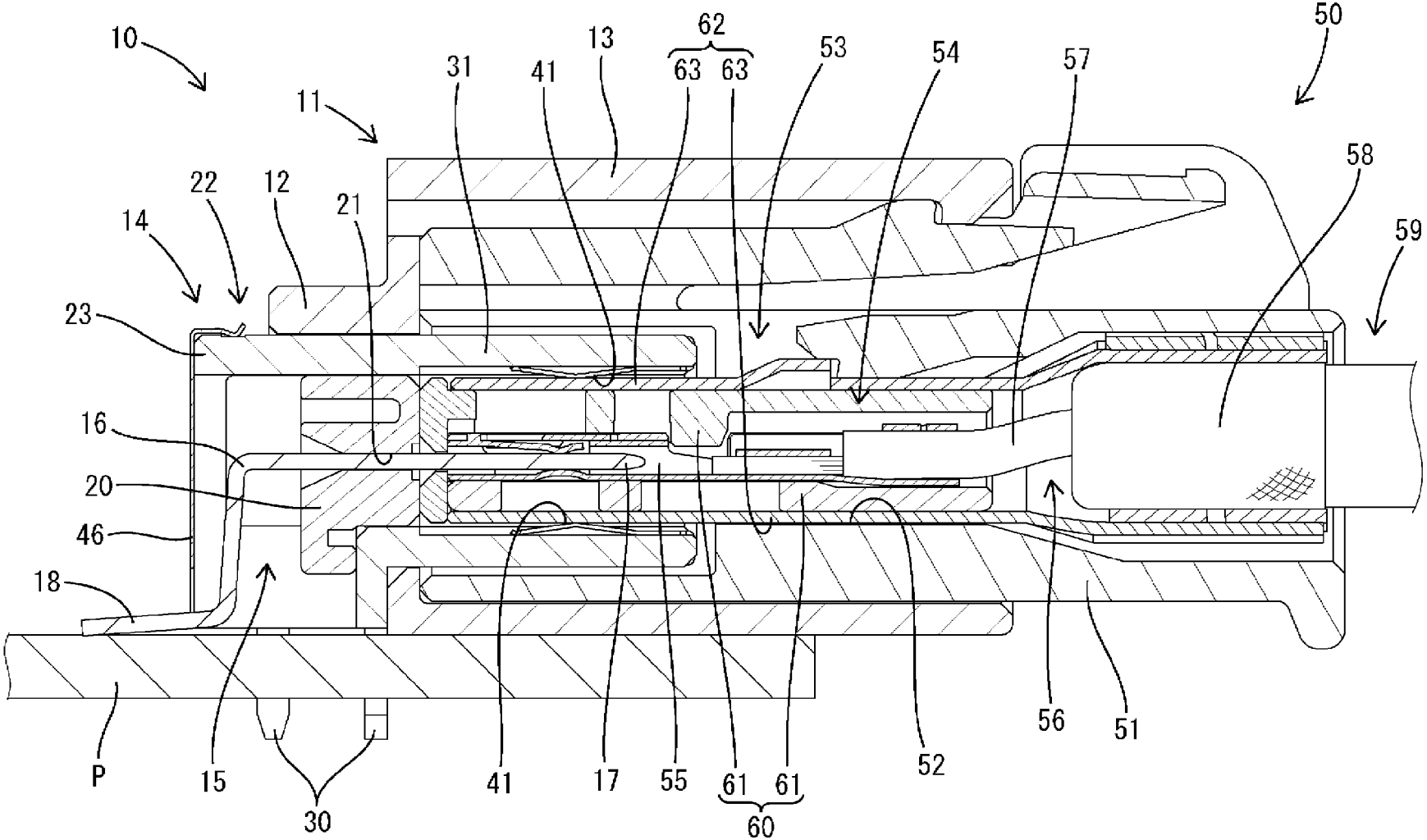
FIG. 12 is a section showing a state where the male shield connector and a female shield connector are connected.

A female shield connector 50 (mating connector as claimed) as a fitting target (connection target) of the above male shield connector 10 includes a female housing 51 and a female shield terminal 53 accommodated in the female housing 51 as shown in FIG. 12. The female housing 51 is a single component made of synthetic resin and internally formed with a terminal accommodation chamber 52.

Figure 10:
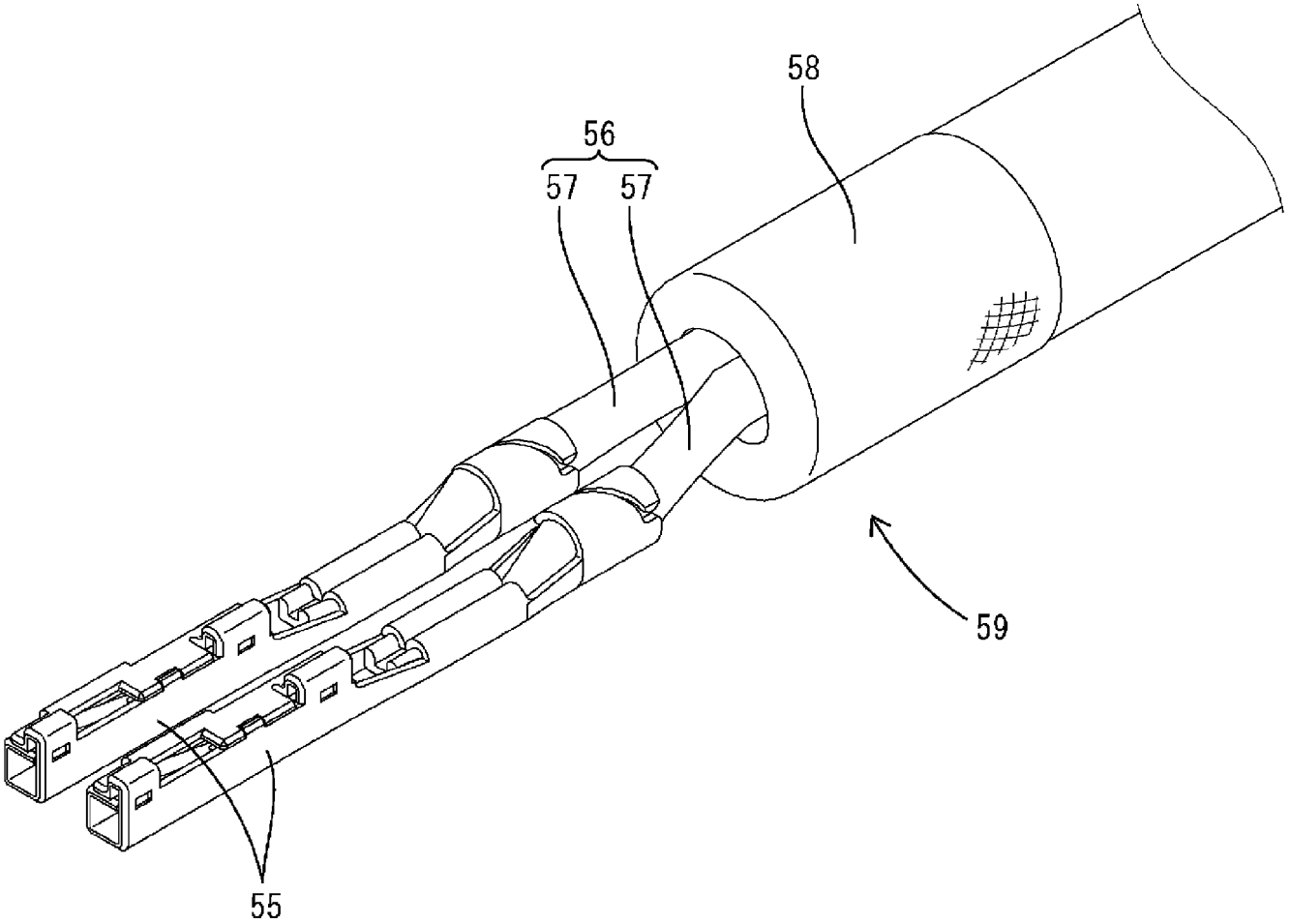
FIG. 10 is a perspective view showing a state where female inner conductors are connected to a twisted pair cable.
Figure 11:
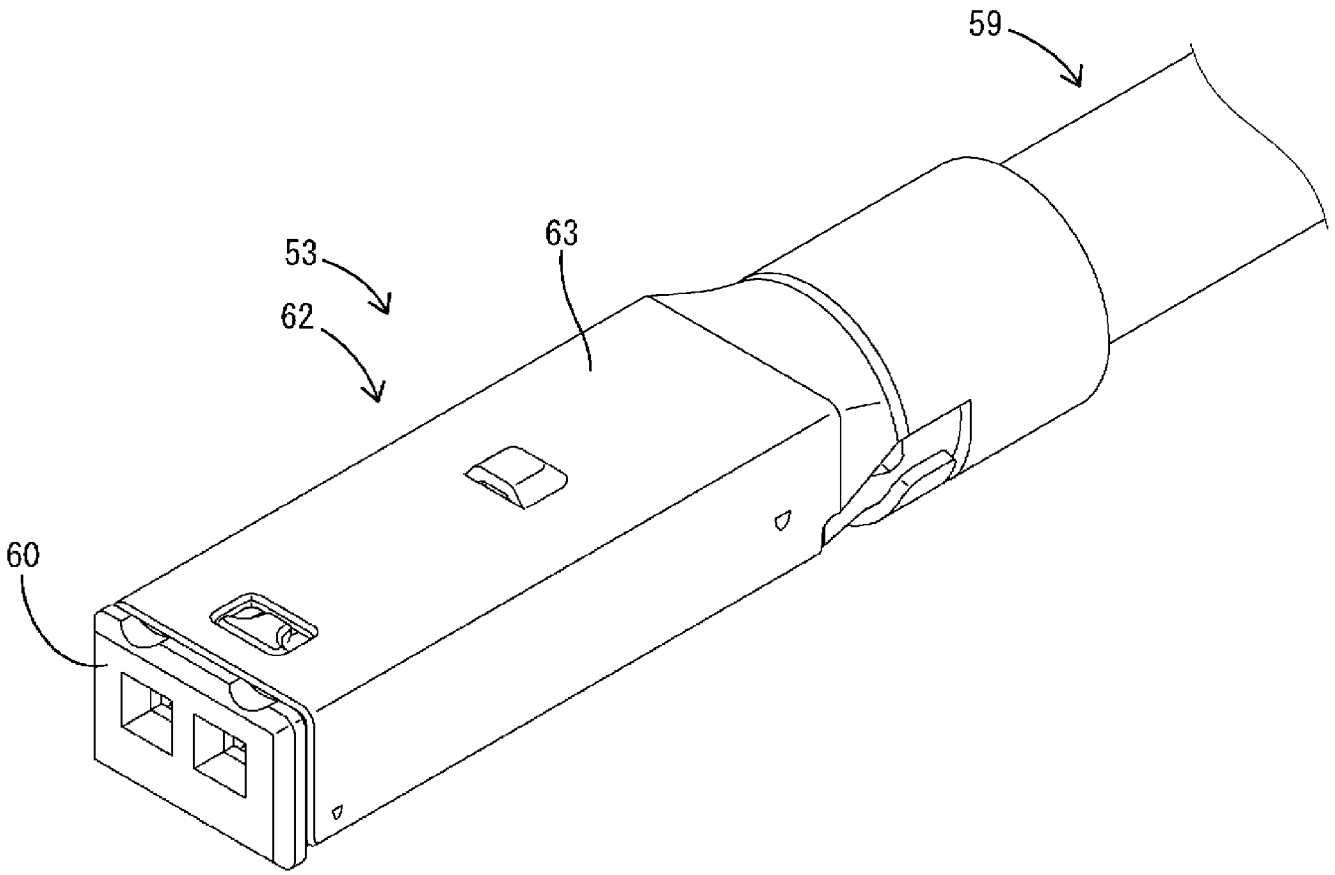
FIG. 11 is a perspective view of a female shield terminal.

The female shield terminal 53 is configured by assembling one female terminal unit 54 and one female outer conductor 62 (mating outer conductor as claimed). The female terminal unit 54 is configured by assembling a pair of left and right female inner conductors 55 and one female dielectric 60. As shown in FIG. 10, the pair of female inner conductors 55 are fixed to end parts of a pair of coated wires 57 constituting a twisted pair cable 56. The twisted pair cable 56 is surrounded by a tubular flexible shield member 58 made of a braided wire, and a shield conductive path 59 is configured by the twisted pair cable 56 and the flexible shield member 58.

The female dielectric 60 is formed by uniting a pair of upper and lower half members 61 made of a synthetic resin material. The pair of female inner conductors 55 are accommodated in the female dielectric 60. The female outer conductor 62 is formed by uniting a pair of upper and lower shells 63 made of metal, and is in the form of a rectangular tube as a whole. By accommodating the female terminal unit 54 into the female outer conductor 62, the female shield terminal 53 is configured.

A rear end part (right end part in FIG. 12) of the female outer conductor 62 is conductively fixed to the flexible shield member 58. The female shield terminal 53 is accommodated into the terminal accommodation chamber 52 of the female housing 51 from behind. By accommodating the female shield terminal 53 into the terminal accommodation chamber 52, the female shield connector 50 connected to the shield conductive path 59 is configured.

The female shield connector 50 is connected to the male shield connector 10 from front. With the both shield connectors 10, 50 connected, the female shield terminal 53 is fit in the tubular portion 31 of the male shield terminal 14 (male outer conductor 22) and the female inner conductors 55 and the tabs 17 of the male inner conductors 16 are conductively connected. Further, the contact point portions 45 of the four resilient contact members 41 mounted on the male outer conductor 22 resiliently contact the outer peripheral surface of the female outer conductor 62 while resiliently deforming the resilient contact pieces 44.

Further, in the process of fitting (connecting) the male and female shield terminals 14, 53, the contact point portions 45 on the inner peripheral surface of the tubular portion 31 slide in contact with the outer peripheral surface of the female outer conductor 62. Thus, with the both shield terminals 14, 53 fit, hardly any air layer is present between the inner peripheral surface of the male outer conductor 22 and the outer peripheral surface of the female outer conductor 62. Further, since the resilient contact pieces 44 are resiliently deformed, the male outer conductor 22 and the female outer conductor 62 are reliably conductively connected.

The male shield connector 10 of the first embodiment includes the male inner conductors 16, the male dielectric 20 for accommodating the male inner conductors 16 and the male outer conductor 22 constituting the male shield connector 10 by surrounding at least a part of the male dielectric 20. The male outer conductor 22 includes the tubular portion 31 to which the female outer conductor 62 of the female shield connector 50 is connected. Since the tubular portion 31 has no boundary dividing the tubular portion 31 in the circumferential direction, the male outer conductor can exhibit a high shielding performance.

That "the tubular portion 31 has no boundary dividing the tubular portion 31 in the circumferential direction" means that "the tubular portion 31 is so formed that a coupling part such as a seam is not present" or that "the tubular portion 31 is so formed that a dividing boundary such as a slit is not present". Specifically, the tubular portion 31 is formed by casting, cutting, press-working or the like. The "coupling part such as a seam" is a "coupling part continuous over the entire length of the tubular portion in the axial direction (front-rear direction) of the tubular portion". Specific examples of the "coupling part such as a seam" include a part coupling end parts of an ended member by a hooking structure, splicing or the like using the ended member having the end parts in a circumferential direction, a part coupling end parts of a pair of united half members, and a part coupling end parts of one plate material bent into a rectangular tube shape. The "boundary such as a slit" is a "boundary continuous over the entire length of the tubular portion in the axial direction (front-rear direction) of the tubular portion". Thus, tubular portions formed by coupling end parts of ended members by locking, splicing or the like such as a tubular portion formed by uniting half members and a tubular portion formed by bending one plate material are not included in the "tubular portion 31 having no boundary dividing (the tubular portion) in the circumferential direction".

Further, since the outer conductor body 23 formed with the base portion 24 and the tubular portion 31 is formed by casting or cutting, a degree of freedom in designing the thicknesses of the base portion 24 and the tubular portion 31 is high as compared to the case where the outer conductor body 23 is formed by press-working. Thus, an increase in the rigidity of the outer conductor body 23 is realized by increasing the thicknesses of the base portion 24 and the tubular portion 31.

Further, the resilient contact members 41 to be electrically conductive with the female outer conductor 62 by resiliently contacting the female outer conductor 62 are mounted on the tubular portion 31. If contact parts with the female outer conductor 62 are integrally formed to the tubular portion 31, the tubular portion 31 needs to be formed with cuts, boundaries or the like. However, since the resilient contact members 41 are components separate from the tubular portion 31, the tubular portion 31 needs not be formed with cuts or boundaries.

Further, focusing on that a large thickness of the tubular portion 31 can be ensured, the groove portions 36 are formed in the tubular portion 31 and the resilient contact members 41 are mounted into these groove portions 36. By increasing the thickness of the tubular portion 31, the groove portions 36 can be made deep without reducing the strength and rigidity of the tubular portion 31. Therefore, the resilient contact members 41 can be reliably mounted on the tubular portion 31 without using fixing means such as welding.

Further, the inner peripheral groove 39 of the groove portion 36 is formed in the inner peripheral surface of the tubular portion 31 and at least a part of the resilient contact member 41 is accommodated in the groove portion 36 (inner peripheral groove 39). Since the inner peripheral groove 39 constitutes a peripheral surface facing the outer peripheral surface of the female outer conductor 62, a clearance between the inner peripheral surface of the tubular portion 31 and the outer peripheral surface of the female outer conductor 62 can be made smaller.

Further, the inner peripheral surface of the tubular portion 31 can slide in contact with the outer peripheral surface of the female outer conductor 62. In this way, a large air layer is not present between the inner peripheral surface of the male outer conductor 22 (tubular portion 31) and the outer peripheral surface of the female outer conductor 62, wherefore shielding performance in a fit part of the male outer conductor 22 and the female outer conductor 62 is excellent in reliability.

Second Embodiment

Figure 13:
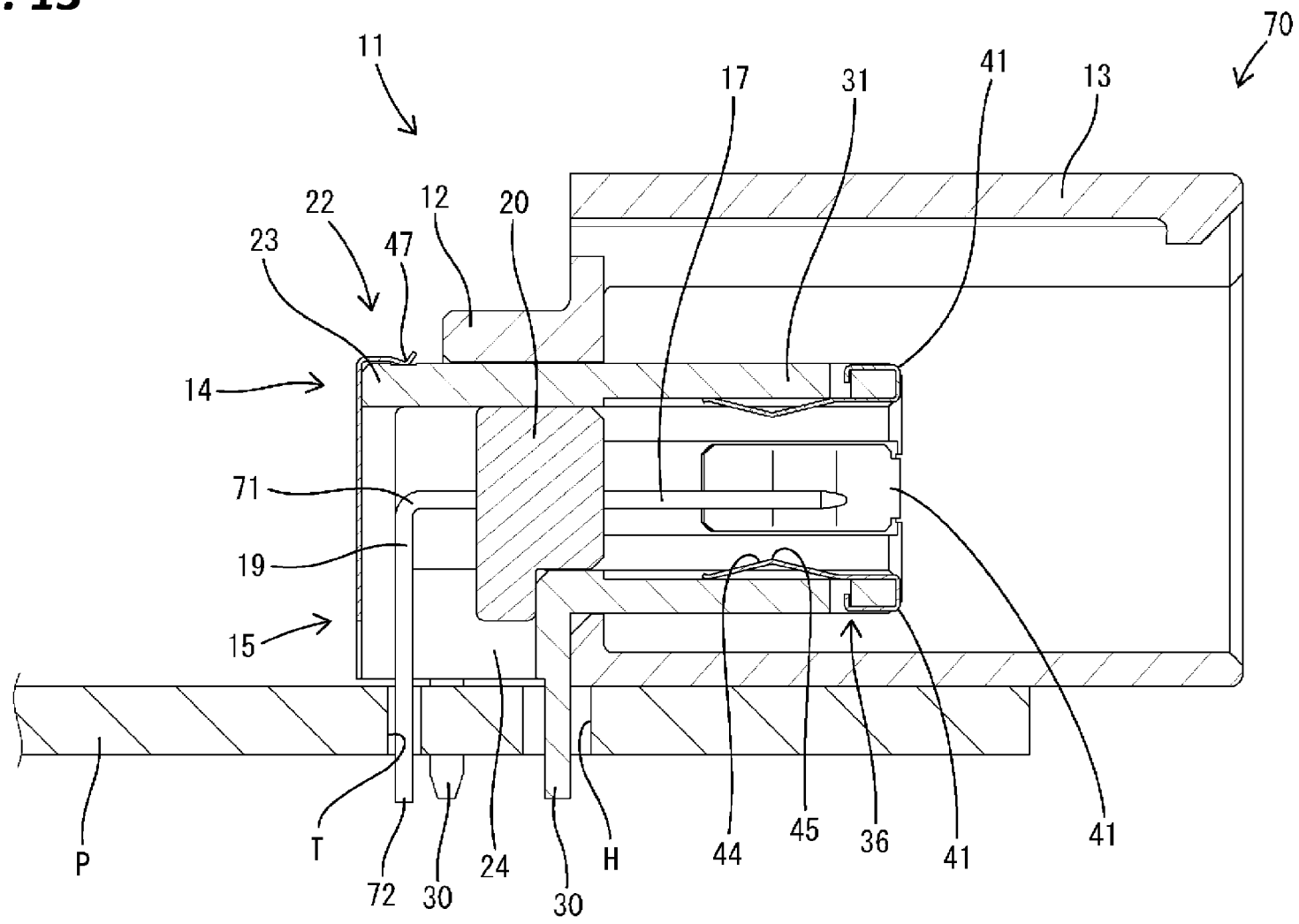
FIG. 13 is a section of a male shield connector of a second embodiment.
Figure 14:
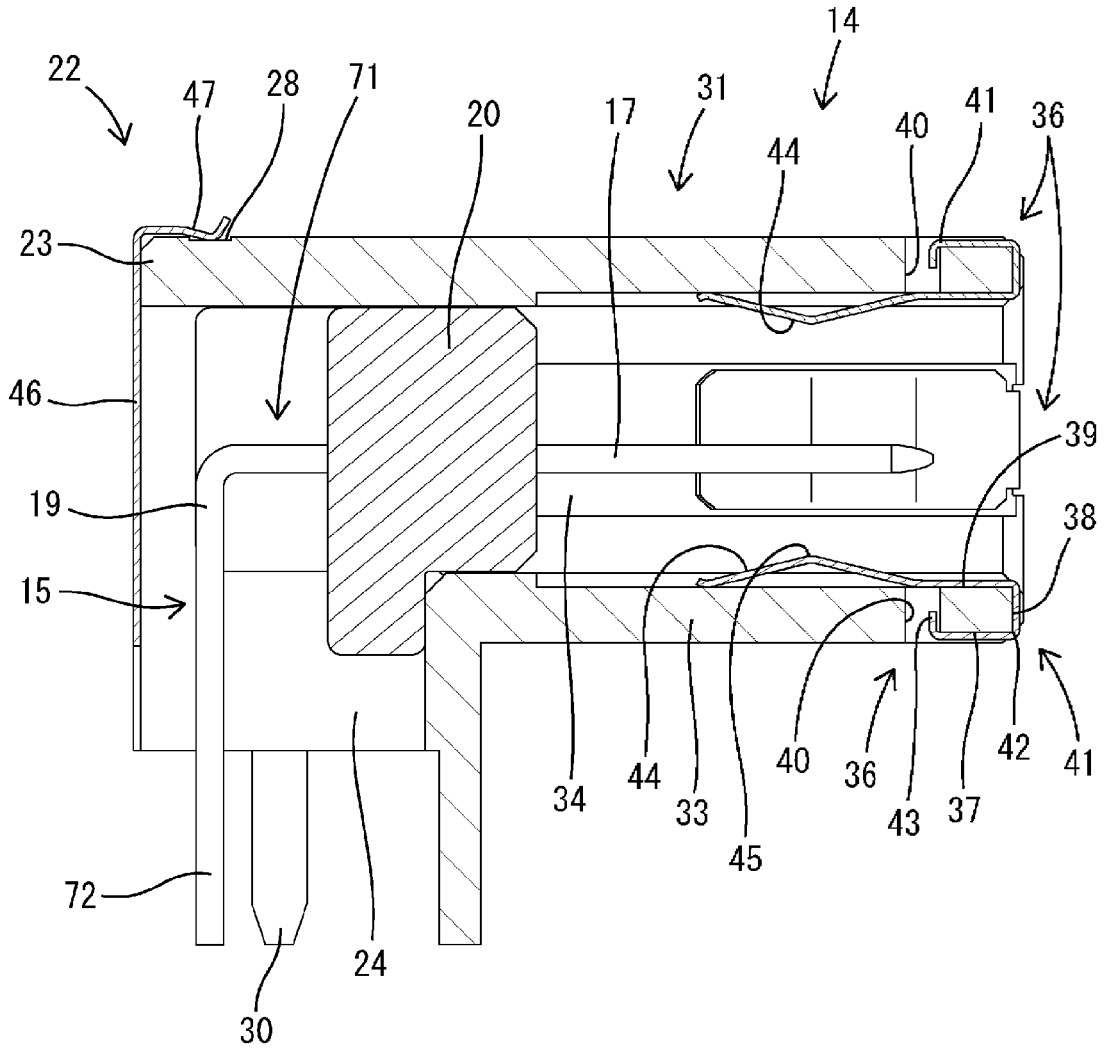
FIG. 14 is a section of a male shield terminal.
Figure 15:
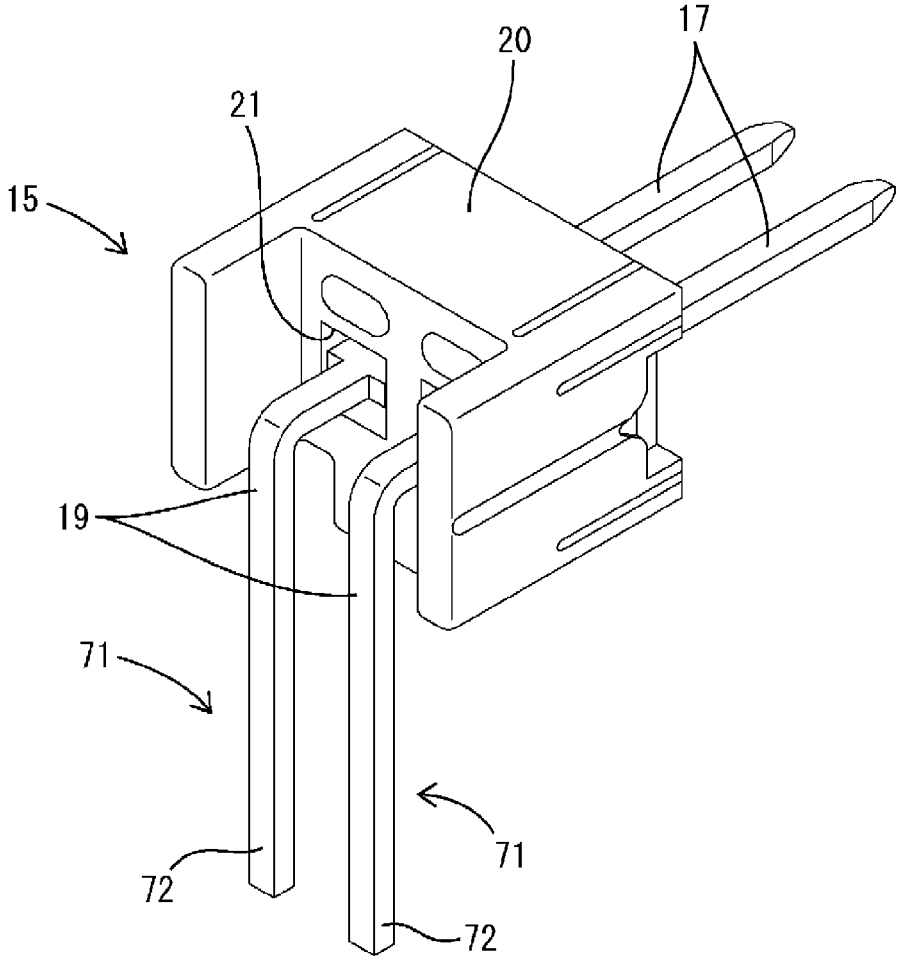
FIG. 15 is a perspective view of a male terminal unit.

Next, a second specific embodiment of the present disclosure is described with reference to FIGS. 13 to 15. The board connecting portions 18 of the male inner conductors 16 of the male shield connector 10 of the above first embodiment are surface-mounted on the circuit board P, whereas board connecting portions 72 of male inner conductors 71 (inner conductor as claimed) of a male shield connector 70 (connector as claimed) of the second embodiment are passed through through holes T of a circuit board P and fixed by soldering (not shown). Since the other configuration is the same as in the above first embodiment, the same components are denoted by the same reference signs and structures, functions and effects thereof are not described.

Other Embodiments

The present invention is not limited to the above described and illustrated embodiments. For example, the following embodiments are also included in the technical scope of the present invention.

Although the tubular portion (outer conductor body) is formed by casting or cutting in the above first and second embodiments, the tubular portion (outer conductor) may be formed by press-working.

Although the male outer conductor and the female outer conductor are connected via the resilient contact members in the above first and second embodiments, the male outer conductor and the female outer conductor may be directly connected without via the resilient contact members or may be connected via members which are not resiliently deformed.

Although the resilient contact members are mounted on the male outer conductor in the above first and second embodiments, the resilient contact members may be mounted on the female outer conductor.

Although the resilient contact members are mounted on both upper and lower wall portions and both left and right wall portions in the form of flat plates, out of the wall portions constituting the tubular portion, in the above first and second embodiments, the resilient contact members may be mounted on the curved wall portions having a substantially quarter-circular shape, out of the wall portions constituting the tubular portion.

Although the male outer conductor is externally fit to the female outer conductor in the above first and second embodiments, the present invention can be applied also to a case where a male outer conductor is fit into a female outer conductor.

Although the tubular portion is formed in the male outer conductor (outer conductor surrounding the male inner conductors) in the above first and second embodiments, the present invention can be applied also to a case where a tubular portion is formed in a female outer conductor (outer conductor surrounding female inner conductors).

LIST OF REFERENCE NUMERALS

10, 70 . . . male shield connector (connector)
11 . . . male housing
12 . . . terminal holding portion
13 . . . receptacle
14 . . . male shield terminal
15 . . . male terminal unit
16, 71 . . . male inner conductor (inner conductor)
17 . . . tab
18 . . . board connecting portion
19 . . . leg portion
20 . . . male dielectric (dielectric)
21 . . . press-fit hole
22 . . . male outer conductor (outer conductor)
23 . . . outer conductor body
24 . . . base portion
25 . . . front surface portion
26 . . . side surface portion
27 . . . upper surface portion
28 . . . hook groove
29 . . . positioning projection
30 . . . positioning pin
31 . . . tubular portion
32 . . . upper wall portion
33 . . . lower wall portion
34 . . . side wall portion
35 . . . curved wall portion
36 . . . groove portion
37 . . . outer peripheral groove
38 . . . front surface groove
39 . . . inner peripheral groove
40 . . . mounting hole
41 . . . resilient contact member
42 . . . fitting portion
43 . . . retaining projection
44 . . . resilient contact piece
45 . . . contact point portion
46 . . . cover
47 . . . hooking portion
48 . . . restricting projection
50 . . . female shield connector (mating connector)
51 . . . female housing
52 . . . terminal accommodation chamber
53 . . . female shield terminal
54 . . . female terminal unit
55 . . . female inner conductor
56 . . . twisted pair cable
57 . . . coated wire
58 . . . flexible shield member
59 . . . shield conductive path
60 . . . female dielectric
61 . . . half member
62 . . . female outer conductor (mating outer conductor)
63 . . . shell
72 . . . board connecting portion
H . . . positioning hole
P . . . circuit board
T . . . through hole

What is claimed is:

1. A connector, comprising:

an inner conductor;

a dielectric; and an outer conductor surrounding the inner conductor and the dielectric, wherein:

the outer conductor includes a tubular portion to which a mating outer conductor of a mating connector is connected, the tubular portion includes no boundary dividing the tubular portion in a circumferential direction, a resilient contact member to be electrically conductive with the mating outer conductor by resiliently contacting the mating outer conductor is mounted on the tubular portion, the resilient contact member includes a substantially U-shaped fitting portion and a resilient contact piece extending from the fitting portion and configured to resiliently contact the mating outer conductor, and the fitting portion is fit in an outer peripheral groove formed by recessing an outer peripheral surface of the tubular portion, a front surface groove formed by recessing a front end surface of the tubular portion and an inner peripheral groove formed by recessing an inner peripheral surface of the tubular portion.

2. An outer conductor constituting a connector by surrounding an inner conductor and a dielectric, comprising:

a tubular portion to which a mating outer conductor of a mating connector is connected, wherein:

the tubular portion includes no boundary dividing the tubular portion in a circumferential direction, a resilient contact member formed such that a resilient contact piece extends from a substantially U-shaped fitting portion is mounted on the tubular portion, the tubular portion is formed with an outer peripheral groove by recessing an outer peripheral surface, a front surface groove by recessing a front end surface and an inner peripheral groove by recessing an inner peripheral surface, and the resilient contact member is made electrically conductive with the mating outer conductor by resiliently bringing the resilient contact piece into contact with the mating outer conductor with the fitting portion fit in the outer peripheral groove, the front surface groove and the inner peripheral groove.

* * * * *